United States Patent [19]

Pinaire et al.

[11] 4,294,687

[45] Oct. 13, 1981

[54] LUBRICATING OIL PROCESS

[75] Inventors: Ronald Pinaire, Park Forest; Gary L. Everett, Chicago Heights, both of Ill.

[73] Assignee: Atlantic Richfield Company, Philadelphia, Pa.

[21] Appl. No.: 106,973

[22] Filed: Dec. 26, 1979

[51] Int. Cl.[3] ..... C10G 45/00; C10G 47/02; C10G 65/12

[52] U.S. Cl. ..... 208/58; 208/89

[58] Field of Search ..... 208/58, 89

[56] References Cited

U.S. PATENT DOCUMENTS

| | | | |
|---|---|---|---|
| 3,159,568 | 12/1964 | Price | 208/89 |
| 3,338,819 | 8/1967 | Wood | 208/89 |
| 3,494,854 | 2/1970 | Gallagher | 208/89 |
| 3,506,568 | 4/1970 | Annesser | 208/89 |
| 3,642,610 | 2/1972 | Divijak et al. | 208/58 |
| 3,666,657 | 5/1972 | Thompson et al. | 208/58 |
| 3,726,790 | 4/1973 | Gallagher et al. | 208/111 |
| 3,912,620 | 10/1975 | Gallagher | 208/89 |

*Primary Examiner*—T. M. Tufariello
*Attorney, Agent, or Firm*—Frank J. Uxa

[57] ABSTRACT

Heavy gas oil is converted to a high quality, high viscosity index lubricating oil stock by improved contacting with hydrogen in three catalytic stages. The gas oil is first hydrotreated to provide a stock more amenable to subsequent hydrocracking, thus permitting the use of less severe conditions in the latter step. The hydrocracked oil is finally subjected to a hydrogenation step to fully meet remaining lubricating oil specifications.

29 Claims, No Drawings

LUBRICATING OIL PROCESS

This invention relates to a convenient, improved process for the production of lubricating oil base stocks having a suitably high viscosity index. More particularly, this invention relates to a three-stage catalytic hydrogenation process for conveniently producing such base stocks of high quality and in high yields.

Various prior art processes have been developed for the hydrogen processing of various hydrocarbon feedstocks not usually suitable for the production of high quality lubricating oils. Additionally, hydrogen processing has been found to be greatly preferred over the acid treating and solvent extraction techniques formerly employed with conventional lubricating oil base stocks. Both improved quality and improved yields are generally realized.

For example, U.S. Pat. No. 3,642,610 relates to a two-stage hydrocracking and hydrotreating process for the production of lubricating oils from not only lubricating oil distillates but also from such generally undesirable stocks as deasphalted residual oils, high-sulfur and high-nitrogen heavy oils, sour oils, and other contaminated stocks. Such processing typically leads to a finished lubricating oil, having a viscosity index of about 90 or higher, in yields of about 60% by volume based on raw stock. More severe processing leads to a finished product having a lower viscosity, and a higher viscosity index in the range of about 120 in yields of about 40% by volume.

It is an object of this invention to provide a convenient and economical improved process for the production of high quality lubricating oil base stocks from mineral oil distillates of suitable lubricating oil viscosity.

It is another object of this invention to produce such lubricating oil base stocks in high yield from available hydrocarbon feedstocks. It is a further object of this invention to provide suitable lubricating oil base stocks having a viscosity index of at least about 90 and usually about 110 or higher.

It is a still further object of this invention to provide such a lubricating oil base stock with a reduced expenditure of process energy. Other objects and advantages of the present invention will become apparent hereinafter.

In one embodiment, the process of this invention comprises the steps of:

(a) contacting a mineral hydrocarbon oil feedstock of lubricating oil viscosity with molecular hydrogen, under hydrotreating conditions, in the presence of a hydrotreating catalyst to form a hydrocarbon oil of lubricating viscosity;

(b) contacting the hydrocarbon oil of lubricating oil viscosity from step (a) with molecular hydrogen, under hydrocracking conditions, in the presence of a hydrocracking catalyst to form a hydrocracked oil of lubricating viscosity; and (c) contacting the hydrocracked oil of lubricating oil viscosity from step (b) with molecular hydrogen, under hydrogenation conditions, in the presence of a hydrogenation catalyst.

The heavy mineral oils treated by the process of the present invention are of lubricating viscosity and preferably, are stocks having at least about 90 weight percent boiling above about 600° F. The feeds are preferably oils of at least about 10 VI, e.g., about 10 to 80, and can be derived from paraffinic or mixed base crude oils. The total or full range oil of lubricating viscosity obtained by the methods of the present invention has a viscosity index in the range of at least about 80, preferably at least about 90, with the increase in the viscosity index of the product being at least about 20, preferably at least about 30, over that of the feed. Both the initial hydrocarbon feedstock and the product of lubricating oil viscosity from the hydrogen processing boil over a considerable temperature range, e.g., over a range of at least about 100° F., often at least about 200° F. The method of the present invention is particularly suitable for treating highly contaminated stocks, containing larger amounts of aromatics and frequently having been subjected only to fractionation and deasphalting. Thus the present method can utilize these economically cheaper feedstocks to produce high quality oils in high yields.

The selected feedstock, as, for example, a heavy vacuum gas oil, is first subjected to a hydrotreating operation where substantial desulfurization and/or denitrogenation occur, and, preferably, substantial hydrogenation of aromatic ring systems. This may be effected in a separate hydrotreating vessel or in a guard chamber preceding the reactor for the subsequent hydrocracking step.

The feedstock is subjected to a hydrotreating operation in the presence of hydrogen with a solid hydrogenation catalyst, preferably at a temperature of about 550° to 825° F., more preferably about 600° to 800° F. The other reaction conditions preferably include pressures of about 1,000 to 5,000 p.s.i.g., more preferably about 1,500 to 3,000 p.s.i.g., space velocities (WHSV) of about 0.3 to 5, more preferably about 0.5 to 3; and molecular hydrogen to feed ratios of about 500 to 3,500 standard cubic feet of hydrogen per barrel of hydrocarbon feed, more preferably about 1,500 to 2,500 standard cubic feet of hydrogen per barrel of hydrocarbon feed.

The solid catalyst employed in the hydrotreating operation is preferably a sulfur-resistant, nonprecious metal hydrogenation catalyst, such as those conventionally employed in the hydrogenation of heavy petroleum oils. Examples of suitable catalytic ingredients are Group VI-B metals, such as molybdenum, tungsten and chromium, and Group VIII metals of the iron group, such as cobalt and nickel. These metals are present in minor, catalytically effective amounts, for instances, about 1 to 30 weight percent of the catalyst, and may be present in the elemental form or in combined form such as the oxides or sulfides, the sulfide form being preferred. Mixtures of these materials or compounds of two or more of the oxides or sulfides can be employed. Examples of such mixtures of compounds are mixtures of nickel and/or cobalt oxides with molybdenum oxide. These catalytic ingredients are generally employed while disposed upon a suitable carrier of the solid oxide refractory types, e.g., predominantly calcined or activated alumina. To avoid undue cracking the catalyst base and other components have little, if any, hydrocarbon cracking activity. Preferably less than about 5 volume percent, more preferably less than about 2 volume percent of the feed is cracked in the hydrotreating stage to produce materials boiling below about 600° F. Commonly employed hydrotreating catalysts have about 1 to 10, preferably about 2 to 5, weight percent of an iron group metal and about 5 to 30, preferably about 10 to 20, weight percent of the Group VI B metal, e.g., molybdenum (calculated as the oxide). Advantageously, the catalyst includes nickel or cobalt together with molybdenum supported on alumina. Such preferred catalysts can be prepared by the method described in U.S. Pat. No. 2,938,002.

After the hydrotreating step, the reactor effluent may be flashed to recover hydrogen for possible recycle and stripped to remove ammonia, hydrogen sulfide, and any light hydrocarbons produced in the treating step, and, optionally, dewaxed.

The heavy liquid effluent is then subjected to a hydrocracking step, where ring opening and further removal of sulfur and nitrogen occurs, which may be carried out in contact with any catalyst system known to possess hydrocracking activity relative to lubricating oil range hydrocarbons. However, it is preferred to employ a catalyst containing at least one Group VIII iron-group metal, such as nickel, iron or cobalt and at least one Group VI-B metal, such as molybdenum, tungsten, and chromium, supported on a base comprising boria and/or silica-alumina together with catalytically active alumina. The metals of the catalyst may be present in the form of free metals or in combined form such as the oxides and sulfides, the sulfides being the preferred form. Examples of such mixtures or compounds are nickel oxide or sulfide with molybdenum or tungsten as the corresponding oxide or sulfide. These catalytic ingredients are employed while disposed on the support which includes silica-alumina and/or boria and a catalytically active alumina. The catalyst is preferably comprised of minor, catalytically effective amounts of nickel, tungsten and/or molybdenum. The Group VIII iron group metal, e.g., nickel, preferably comprises about 1–15 weight percent of the catalyst, more preferably about 2–10 weight percent, with the total amount of Group VI-B metal, e.g., tungsten and/or molybdenum and/or chromium, being preferably about 5–30 weight percent, more preferably about 10–25 weight percent, of the catalyst on a metal oxide basis.

When boria is present, it is preferably in an amount of about 2 to 10 weight percent based on the total weight of the catalyst.

Of course, other components may be included in the catalysts useful in the present process, provided that such components do not unduly and deletoriously affect the functioning of the catalysts.

The hydrocracked oil product of this hydrocracking process step generally has a higher viscosity index than the hydrocarbon oil fed to this process step.

One catalyst composition useful in the hydrocracking stage of the present invention can be prepared by adding the Group VIII iron group metal or metals and the Group VI-B metal or metals and the boria component to the support, e.g., alumina, by the various methods known in the art, for example, by impregnation or precipitation and coprecipitation using suitable compounds of the metals and boron. For example, alumina particles containing boria or a material which upon heating yields boria, can be mixed with aqueous ammonia solutions containing nickel and tungsten, and/or molybdenum, or other aqueous solutions of water-soluble compounds of nickel and tungsten and/or molybdenum, so that the metal components are absorbed on the alumina particles. Alternatively, the promoting materials can be precipitated on the boria-containing alumina base through suitable reaction of an aqueous slurry of the base containing water-insoluble salts of the promoting metals. The boria-containing particles can be formed into macrosize either before or after being mixed with the metal components. The catalyst can be dried and calcined, e.g., at temperatures of about 800° to 1,200° F., or somewhat more. Prior to use, the catalyst is preferably sulfided at elevated temperature, e.g., using conventional methods.

A second specific catalyst composition useful in the hydrocracking stage of the present invention includes a support which contains a total of about 30% to about 70% by weight of silica and about 70% to about 30% by weight of alumina, preferably about 35% to about 65% by weight of silica and about 65% to about 35% by weight of alumina. This support is a composite formed by the combination of about 40% to about 90%, preferably about 40% to about 85%, by weight of amorphous silica-alumina and about 10% to about 60%, preferably about 15% to about 60% by weight of alumina derived from hydrous alumina selected from the group consisting of boehmite, amorphous hydrous alumina and mixtures thereof, preferably boehmite and mixtures of boehmite and amorphous hydrous alumina. The amorphous silica-alumina component of the catalyst may be available in the form of relatively finely divided particles, e.g., of a particle size of up to about 65 microns, and contain about 40% to about 92% by weight of silica and about 8% to about 60% by weight of alumina. Commercially available silica-alumina hydrocarbon cracking catalyst particles can be used in making such a catalyst useful in the hydrocracking step of this invention and, in one instance, can contain 87% weight percent silica and 13% weight percent alumina.

The silica-alumina component of this second catalyst useful in the hydrocracking step of the present invention may also be prepared by conventional methods similar to those methods known to the art for the production of synthetic silica-alumina cracking catalyst. Such preparations may involve forming a silica hydrogel by the precipitation of an alkali metal silicate solution with an acid such as sulfuric acid. Alumina is then precipitated by adding an alum solution to the silica hydrogel slurry and raising the pH into the alkaline range by the addition of sodium aluminate solution or by the addition of a base such as ammonium hydroxide. These conventional methods for producing silica-alumina also include co-precipitation techniques wherein the acid-acting alum solution is added to the silicate solution to precipitate both silica and alumina simultaneously, perhaps with a pH adjustment for further precipitation. Also, a constant pH technique whereby the solutions of each oxide component are added continuously to a mixing vessel may be employed. In any event, the alumina is precipitated in the presence of silica to form what may be referred to as coherent aggregates of silica-alumina. Although the amorphous silica-alumina component of the present catalyst supports may have a wide range of surface areas, for example, about 50 $m.^2/gm.$ to about 500 $m.^2/gm.$ or more, it is preferred that the silica-alumina have a surface area of at least about 300 $m.^2/gm.$ The surface areas referred to herein are as determined by the BET nitrogen absorption procedure (JACS, vol. 60, pp. 309 et seq., 1398).

The added alumina content of the second catalyst useful in the hydrocracking step of the present invention is obtained by combining alumina as hydrous alumina with the silica-alumina which may be, at the time of hydrous alumina addition, in any stage of manufacture, from the original crude hydrogel as precipitated and separated from the aqueous supernatent liquid to the completely finished silica-alumina product in either dried or calcined form.

The second hydrocracking catalyst support may be prepared by precipitation of hydrous alumina in the presence of the silica-alumina at a pH of about 5 to about 9, or the alumina hydrogel may be prepared separately. In either case, the preparation is such as to produce a support having added alumina in the form derived from hydrous alumina selected from the group consisting of boehmite, amorphous hydrous alumina and mixtures thereof, preferably from the group consisting of boehmite and mixtures of boehmite and amorphous hydrous alumina. The term "boehmite" or "boehmite alumina" includes both well crystallized boehmite and poorly crystallized boehmite, sometimes called pseudoboehmite. Preferably, the boehmite alumina has a crystallite size of up to about 50 A. as determined by X-ray diffraction on samples dried to 110° C. When mixtures of boehmite and amorphous hydrous alumina are used, the boehmite preferably comprises about 45% to about 85% by weight of the mixture and the amorphous hydrous alumina comprises about 15% to about 55% by weight of the mixture.

The hydrous alumina precursor of the added alumina of the second catalyst useful in the hydrocracking step of the present invention can be prepared by various methods. Separate preparation of the hydrous alumina may be, for example, by precipitation of alumina at alkaline pH by mixing alum with sodium aluminate in aqueous solution or with a base such as soda ash, ammonia, etc. The solution from which the hydrous alumina is precipitated may contain a concentration of about 5% to about 20% by weight of the alumina salt. Ammonia, or more preferably ammonia water, or other aqueous base, can be added to the solution until the desired amount of alumina hydrate gel is precipitated. Preferably, at the end of precipitation, the slurry is so thick that it just barely can be stirred. After formation of the alumina hydrogel is complete, it may be filtered or decanted prior to its combination with the silica-alumina. The alumina hydrogel filter cake may be water washed to remove part or most of its ion content, e.g., sulfate and sodium ion present in the gel, but preferably this step is omitted. Thereafter, the alumina hydrogel is ready for mixing with the silica-alumina material, for example, silica-alumina hydrogel, and the combined hydrogel slurry is stirred continuously until a uniform mixture is obtained, usually about 30 to about 60 minutes stirring time is sufficient. The aqueous hydrous alumina-silica-alumina slurry may then be washed and concentrated as by settling and the aqueous material filtered off after which the catalyst precursor is thoroughly washed to remove interferring ions, especially, sodium and sulfate ions. The final hydrocracking catalyst support preferably contains less than about 0.5% by weight sulfate.

The hydrous alumina precursor may be prepared in the presence of the silica-alumina component of the second hydrocracking catalyst support. In this procedure, the hydrated gel is preferably formed by reacting an aqueous solution of an aluminum salt of a strong inorganic acid, usually aluminum sulfate, with a base preferably ammonia water, at a pH which may vary within the range of about 5 to about 9, preferably substantially all of the alumina is precipitated at a pH of about 7 to about 7.5. Precipitation of alumina from an aqueous solution of an alkali aluminate by addition of an acid may also be employed. Also, the hydrous alumina may be precipitated by hydrolysis from alcohol solutions of aluminum alkoxides although the use of inorganic salts is preferred.

One particularly preferred method for preparing this precursor hydrous alumina is by the conventional acid hydrolysis of finely divided aluminum. In this manner, the dispersion or slurry of hydrous alumina prepared by this method can contain amorphous alumina as well as boehmite.

In the acid hydrolysis process, aluminum, preferably in a state of extremely fine subdivision and high surface area, is contacted with water, preferably at a temperature near the boiling point of water, in the presence of a non-oxidizing acid. The reaction produces a fine particle hydrous alumina slurry in water, the hydrous alumina comprising either boehmite or both of the valuable boehmite and amorphous forms.

Once the aqueous hydrous alumina-silica-alumina slurry is obtained, particles of the second hydrocracking catalyst support may be formed, washed, dried and calcined using methods well known in the art. It may be necessary to adjust the free water concentration of the above-noted slurry depending on how the catalyst support particles are to be formed. Tabletting, for example, generally requires a dryer mix than does extruding, which usually calls for a free water content of about 20% to about 40% by weight. Therefore, the slurry may be partially dried. The temperature at which the drying is performed is not critical but it is generally preferred to operate at temperatures up to about 400° F. It may be—because of the type of equipment employed, or for whatever reason—that it is preferable to dry the slurry completely, or relatively so, and then add back sufficient water to obtain a formable, e.g., extrudable, coagulable (for spheridizing) etc., mix. In many instances, for example, when the final catalyst is to be in the form of extrudates, tablets, pills and the like, the slurry may be dried, for example, by spray-drying, to form microspherical particles which can be impregnated with the Group VIb and/or Group VIII metal using methods well known in the art. This impregnated material may be formed, dried and calcined using conventional methods to produce the second hydrocracking catalyst useful in the present invention. Also, the catalytically-active metals may be added after the support is formed, washed, dried and calcined and when the catalyst is to be in the form of spheres produced by the oil drop method, this procedure is preferred.

The formed particles are calcined at temperatures sufficient to effect the release of water of hydration from the particles and to provide a catalytically active alumina. Generally suitable are temperatures of about 600° F. to about 1350° F., preferably about 800° F. to about 1150° F. The calcination can be effected in an oxidizing, reducing or inert atmosphere, the more economical use of a dry air calcining atmosphere being preferred. It is usually advantageous to calcine in a flowing stream of the gaseous atmosphere. Pressure can be atmospheric, super-atmospheric or sub-atmospheric. Preferably, the second hydrocracking catalyst has a surface area of at least about 140 $m.^2/gm$.

When the above-noted commercially available silica-alumina particles are to be used in combination with hydrous alumina to form generally spherical catalyst supports, it is preferred that the silica-alumina particles be added in more or less dry conditions, e.g., either dried-milled or dried, wet-milled, to the hydrous alumina product to prevent further dilution of the slurry.

The mixture of silica-alumina and alumina is fed to a spheridizing column to form the generally spherical support. The spheres can be, for example, up to about ⅛ inch in diameter, often about 1/64 inch in diameter. The spheres may be prepared by the oil-drop method, for example, as disclosed in U.S. Pat. No. 3,558,508.

After calcination, the second hydrocracking catalyst support particles, e.g., spheres, may be impregnated with the catalytic metals. These metals can be present in the final catalyst either as the free metals or in combined form such as the oxides and sulfides. Especially preferred catalysts contain nickel together with tungsten oxide or sulfide and/or molybdenum oxide or sulfide.

The impregnation can be carried out as is known in the art. The metal is preferably in solution as a compound which is a precursor of the form, e.g., free metal, metal oxide or metal sulfide, desired in the catalyst. For example, to prepare a catalyst containing nickel and molybdenum oxides, a solution of nickel nitrate and ammonium molybdate in ammonia and water can be used as the impregnating solution. The impregnated support can then be dried, as, for example, at a temperature of about 200° F. to about 270° F. for a time such as 15 to 20 hours, and then calcined in flowing air at a temperature of about 900° F. to about 1000° F. for about 2 hours to about 4 hours. Alternatively, ammonium molybdate can be dissolved in a solution of aqueous ammonia, prepared by admixing 29% ammonia and water in a ratio of 1.76:1, with nickel nitrate than being added to this solution to form a nickel-amine complex. This complex solution can then be used as the impregnant with the impregnated support being dried and calcined as before. The impregnation of the support with the catalytic metal solutions can also be performed sequentially, for example, impregnation with a solution of ammonium molybdate in ammonia followed by drying and calcination of the particles and then impregnation of the molybdenum-oxide containing support with a solution of nickel nitrate followed by another drying and calcination. Alternatively, the support may be impregnated with the nickel salt first.

The impregnated support can be reduced in hydrogen, as by heating the support in a stream of hydrogen at a temperature of about 400° F. to about 1000° F., preferably about 500° F. to about 800° F. To convert the metal and/or metal oxides in the catalyst to the sulfides, the support containing the metals in oxide form as obtained from the calcination may be sulfided using conventional techniques, e.g., by passing hydrogen sulfide and/or a precursor thereof, either pure or diluted with another fluid, such as, for instance, hydrogen, over the catalyst bed at temperatures usually below about 900° F. preferably about 400° F. to about 600° F., for a time sufficient to convert a major portion of the oxides of the metal components to their respective sulfides.

The hydrocracking step of the present invention is carried out under conditions designed to selectively crack the feed so that opening of aromatic and naphthenic rings is favored, rather than the splitting of chains into lower molecular weight compounds. As an example, in the production of 90 VI oils by the method of this invention, cracking may take place to the extent that from about 5 to 10 percent by volume of the product of the hydrocracking stage is material boiling below about 600° F. In the production of 120 VI oils, about 30 to about 50 percent by volume of the product of the hydrocracking stage may be comprised of such materials. Such conditions preferably include a temperature of about 700° F. to 875° F. more preferably about 750° F. to 850° F. The other reaction conditions preferably include a hydrogen partial pressure of about 1,000 to 5,000 p.s.i.g., more preferably about 1,500 to 3,000 p.s.i.g. The amount of free hydrogen employed during hydrocracking is preferably about 1,000 to 5,000 standard cubic feet per barrel of hydrocarbon feed, more preferably about 1,500 to 3,000 standard cubic feet per barrel. The weight hourly space velocity (WHSV), weight units of feed introduced into the reaction zone per weight unit of catalyst per hour, is preferably in the range of about 0.3 to 3, more preferably about 0.5 to 2.

The reactor effluent from the hydrocracking stage may be flashed to recover hydrogen for possible recycle and then stripped with steam or topped to remove ammonia, hydrogen sulfide, and light hydrogenated components. The degree of stripping or topping desired will depend on the particular lubricating oil fraction being processed and the particular contacting conditions employed. Thus, the amount of overhead that may be taken off may often vary from about 0 to about 50 volume percent based on the hydrocarbon feed to the hydrocracking stage. The resulting lubricating oil product may then be fractionated, as desired, and dewaxed. The dewaxing step can be carried out, for example, by pressing or by solvent extraction employing methyl ethyl ketone and toluene or other suitable solvent systems.

The hydrocracked lubricating oil fraction from the second contacting step is then subjected to a third, or hydrogenation, step to provide a finished lubricating oil base stock readily meeting specifications. The conditions in this third contacting step are preferably chosen so that less than about 5 volume percent, more preferably less than 2 volume percent, of the hydrocarbon feed to this third step which boils above about 600° F. is cracked to produce material boiling below about 600° F. This third contacting step preferably occurs at a temperature from about 450° F. to about 800° F., and still more preferably from about 450° F. to about 650° F. This latter contacting step preferably occurs at a pressure in the range from about 1,000 p.s.i.g. to about 5,000 p.s.i.g., more preferably from about 2,000 p.s.i.g. to about 3,000 p.s.i.g.; a WHSV from about 0.1 to about 3.0, more preferably from about 0.25 to about 2.0; and at a hydrogen to hydrogenated oil ratio within the range from about 500 s.c.f./b. to about 5,000 s.c.f./b., more preferably from about 1,500 s.c.f./b. to about 5,000 s.c.f./b.

Although dewaxing may be conducted, as indicated, after the first or second step, or after each of the first and second steps, it is preferred to conduct the dewaxing operation after the third, or final, catalytic processing step. The dewaxed product of this final processing step thus comprises the improved lubricating oil base stock of the present invention.

The description of suitable hydrogenation catalysts useful in the third contacting step of the present invention is substantially similar to that given for the presently useful hydrotreating catalysts. In a preferred embodiment, the hydrogenation catalyst used in the third contacting step is identical with the hydrotreating catalyst of the first contacting step of the present invention.

The catalysts employed in this invention are preferably disposed in the reaction zone or zones as fixed beds. Such fixed bed catalysts may be formed into macrosize particles of any desired shape such as pills, tablets, extrudates, granules, spheres, and the like, using conventional methods. The preferred size for the catalyst particles will generally be within the range from about 1/64 to about ¼ inch, preferably from about 1/16 to about ⅛ inch, in diameter, and from about 1/16 to about one inch, in length. Spherical particles having a diameter of about 1/16 to about ⅛ inch are often useful in fixed bed reactor systems.

In this sequence of catalytic steps of this invention, the initial hydrotreating of the heavy feedstock leads to substantial benefits. For example, the severity required in the hydrocracking step may be reduced, e.g., by from about 35% to about 50%, based on observed space velocities required to produce an acceptable lubricating oil base stock of suitably high viscosity index. This results in a reduced process energy requirement and in a substantially longer hydrocracking catalyst life.

The initial hydrotreating step renders the feedstock more amenable to hydrocracking than is observed in the absence of such a step.

The interdependence of the sequential catalytic contacting steps of this invention leads to a highly desirable processing combination. The first hydrotreating step greatly improves the quality of the feed to the hydrocracking step. This permits the hydrocracking to be conducted effectively but at milder conditions than otherwise permissable. The resultant use of higher space velocity, for example, significantly reduces catalyst requirements and cost. The overall improvement observed in these first two steps, in turn, makes possible the realization of an excellent yield of higher quality lubricating oil base stock from the third catalytic contacting step not otherwise generally available, especially from the less desirable feedstocks.

The following examples are illustrative, without limitation, of the improved process of this invention:

A waxy heavy vacuum gas oil having the feedstock properties set forth in Table I was hydrotreated at 650° F., 1.5 WHSV, 2,500 p.s.i.g. and 2,500 s.c.f./b. hydrogen over a commercial nickel-molybdenum on alumina catalyst, containing 2.5 wt. % nickel and 15 wt. % molybdenum, on an oxide basis. After topping and dewaxing a sample of the effluent oil the properties were as set forth in Table I for Step 1 product.

The hydrotreated product was then hydrocracked at 775° F., 0.6 WHSV, 2,750 p.s.i.g. and 2,500 s.c.f./b. hydrogen over a nickel-molybdenum on alumina, silica-alumina supported catalyst, containing 7 wt. % nickel and 24 wt. % molybdenum, on an oxide basis, together with substantially equal weight portions of silica and alumina. The properties of a dewaxed sample of the product lubricating oil were as set forth in Table I for Step 2 product. When these properties were compared with those of product oils processed without the initial hydrotreating step, as in Product A in Table I, it was found that such latter processing would have required a space velocity (WHSV) of 0.36 rather than the space velocity of 0.6 employed in this run. This represents a decrease of 40% in hydrocracking severity.

Further hydrogenation of a hydrocracked oil, such as the Step 2 product or, for example, Product A in Table I, at hydrogenation conditions including 650° F., 0.3 WHSV, 2,500 p.s.i.g. and 2,500 s.c.f./b. hydrogen over a commercial nickel-molybdenum on alumina catalyst, as employed in the hydrotreating step, served to further improve the base stock qualities of the lubricating oil fraction. For example, the aromatics content was reduced to 1.0 wt. % and the hydrogen content was increased to 14.02 wt. %, with substantially no decrease in oil yield or boiling range. The viscosity index increased to 117 and the ASTM color improved to <0.5. Ultraviolet absorbance readings were acceptably low.

When the hydrotreated product is hydrocracked at 775° F., and 0.5 WHSV, 2,750 p.s.i.g., and 2,500 s.c.f./b. hydrogen over a nickel-molybdenum-boria-alumina catalyst, containing 2.3 wt. % nickel, 15.6 wt. % molybdenum, on an oxide basis, and 5.0 wt. % boria, substantially identical properties are observed in the hydrocracked lubricating oil stock. Further hydrogenation, as above, similarly yields a high quality lubricating oil base stock.

TABLE I

| | | Product | | |
|---|---|---|---|---|
| | Feedstock | Step 1[a] | Step 2[a] | Step A |
| Gravity, °API | 21.4 | 22.6 | 34.6 | 33.9 |
| Pour Point, °F. | 110 | −5 | 5 | 5 |
| Viscosity Index | 40 | 55 | 113 | 115 |
| Aromatics, wt. % | 49.1 | 42.8 | 7.7 | 10.0 |
| Sulfur, wt. % | 1.80 | 0.56 | 0.001 | 0.002 |
| Hydrogen, wt. % | 12.13 | 12.43 | 13.94 | 13.87 |
| Nitrogen, p.p.m. | 1380 | 823 | 2 | 2 |
| Color, ASTM | | <4.5 | <1.5 | <1.5 |
| Distillation, ASTM | | | | |
| IBP/5% | 626/751 | 607/695 | 546/585 | 540/586 |
| 10/20 | 765/781 | 729/769 | 612/661 | 614/664 |
| 30/40 | 802/817 | 797/821 | 706/743 | 708/743 |
| 50/60 | 834/853 | 843/868 | 774/802 | 774/802 |
| 70/80 | 874/897 | 893/922 | 832/870 | 833/873 |
| 90/95 | 936/955 | 959/986 | 917/951 | 919/955 |
| Fraction of Waxy Feed, wt. % | 100 | | 52.6 | 59.2 |

[a]Dewaxed.

While this invention has been described with respect to various specific examples and embodiments, it is to be understood that the invention is not limited thereto and that it can be variously practiced within the scope of the following claims:

What is claimed is:

1. A process for preparing a mineral hydrocarbon lubricating oil base stock comprising:

(a) contacting a mineral hydrocarbon oil feedstock of lubricating oil viscosity with molecular hydrogen in the presence of a hydrotreating catalyst under hydrotreating conditions to avoid undue cracking of said feedstock such that less than about 5% by volume of said feedstock is cracked to produce materials boiling below about 600° F.;

(b) contacting the effluent oil from step (a) with molecular hydrogen in the presence of a hydrocracking catalyst under hydrocracking conditions; and (c) contacting the effluent oil from step (b) with molecular hydrogen in the presence of a hydrogenation catalyst under hydrogenation conditions such that less than about 5% by volume of said effluent oil from step (b) which boils above 600° F. is cracked to produce material boiling below about 600° F.

2. The process of claim 1 wherein the hydrocarbon oil feedstock has a viscosity index within the range from about 10 to about 80, and wherein at least about 90 wt. % of said feedstock boils above about 600° F.

3. The process of claim 1 wherein the product oil from step (c) is additionally dewaxed to provide the lubricating oil base stock.

4. The process of claim 1 wherein said hydrocracking catalyst comprises minor, catalytically effective amounts of at least one Group VI b metal component, at least one Group VIII iron group metal component and at least one boron component, and a major amount of alumina.

5. The process of claim 4 wherein the hydrocarbon oil feedstock has a viscosity index within the range from about 10 to about 80, and wherein at least about 90 wt. % of said feedstock boils above about 600° F.

6. The process of claim 4 wherein the hydrotreating conditions include a temperature within the range from about 550° F. to about 825° F., a hydrogen partial pressure within the range from about 1,000 to about 5,000 p.s.i.g., a weight hourly space velocity within the range from about 0.3 to about 5.0, and a hydrogen to hydrocarbon feed ratio within the range from about 500 to about 3,500 s.c.f./b., and less than about 2% by volume of said feedstock is cracked to produce materials boiling below about 600° F. at said hydrotreating conditions.

7. The process of claim 4 wherein the hydrocracking conditions include a temperature within the range from about 700° F. to about 875° F., a hydrogen partial pressure within the range from about 1,000 to about 5,000 p.s.i.g., a weight hourly space velocity within the range from about 0.3 to 3.0 and a hydrogen to hydrocarbon feed ratio within the range from about 1,000 to about 5,000 s.c.f./b.

8. The process of claim 4 wherein the hydrogenation conditions of step (c) include a temperature within the range from about 450° F. to about 800° F. a hydrogen partial pressure within the range from about 1,000 to about 5,000 p.s.i.g. a weight hourly space velocity within the range from about 0.1 to about 3.0, and a hydrogen to hydrocarbon feed ratio within the range from about 500 to about 5,000 s.c.f./b.

9. The process of claim 4 wherein the hydrotreating catalyst of step (a) comprises from about 1 to about 10 wt. % of at least one Group VIII iron group metal and from about 5 to about 30 wt. % of at least one Group VI b metal, on an oxide basis.

10. The process of claim 9 wherein the hydrotreating catalyst is in the sulfide form.

11. The process of claim 4 wherein hydrocracking catalyst includes from about 2 to about 10 weight % of at least one Group VIII iron group metal, from about 15 to about 25 wt. % of at least one Group VI b metal, on an oxide basis, and from about 2 to about 10 wt. % of boria.

12. A process for preparing a mineral hydrocarbon lubricating oil comprising:

(a) contacting a mineral hydrocarbon oil feedstock of lubricating oil viscosity with molecular hydrogen under hydrotreating conditions to avoid undue cracking of said feedstock such that less than about 5% by volume of said feedstock is cracked to produce materials boiling below about 600° F., in the presence of a supported hydrotreating catalyst comprising minor, catalytically effective amounts of at least one Group VI b metal component and at least one Group VIII, iron group metal component;

(b) contacting hydrocarbon oil of lubricating oil viscosity from step (a) with molecular hydrogen under hydro-cracking conditions, in the presence of a hydrocracking catalyst comprising minor, catalytically effective amounts of at least one Group VI b metal component and at least one Group VIII, iron group metal component, on a support comprising silica-alumina together with alumina; and (c) contacting hydrocarbon oil of lubricating oil viscosity from step (b) with molecular hydrogen under hydrogenation conditions in the presence of a supported hydrogenation catalyst comprising minor, catalytically effective amounts of at least one Group VI b metal component and at least one Group VIII, iron group metal component such that less than about 5% by volume of said effluent oil from step (b) which boils above 600° F. is cracked to produce material boiling below about 600° F.

13. The process of claim 12 wherein the hydrocarbon oil feedstock has a viscosity index within the range from about 10 to about 80, and wherein at least about 90 wt. % of said feedstock boils above about 600° F.

14. The process of claim 12 wherein the hydrotreating conditions include a temperature within the range from about 550° F. to about 825° F., a hydrogen partial pressure within the range of about 1,000 to about 5,000 p.s.i.g., a weight hourly space velocity within the range from about 0.3 to about 5.0, and a hydrogen to hydrocarbon feed ratio within the range from about 500 to about 3,500 s.c.f./b., and less than about 2% by volume of said feedstock is cracked to produce materials boiling below about 600° F. at said hydrotreating conditions.

15. The process of claim 12 wherein the hydrocracking conditions include a temperature within the range from about 700° F. to about 875° F., a hydrogen partial pressure within the range from about 1,000 to about 5,000 p.s.i.g., a weight hourly space velocity within the range from about 0.3 to 3.0 and a hydrogen to hydrocarbon feed ratio within the range from about 1,000 to about 5,000 s.c.f./b.

16. The process of claim 12 wherein the hydrogenation conditions of step (c) include a temperature within the range from about 450° F. to about 800° F., a hydrogen partial pressure within the range from about 1,000 to about 5,000 p.s.i.g., a weight hourly space velocity within the range from about 0.1 to about 3.0, and a hydrogen to hydrocarbon feed ratio within the range from about 500 to about 5,000 s.c.f./b.

17. The process of claim 12 wherein the hydrotreating catalyst of step (a) comprises from about 1 to about 10 wt. % of at least one Group VIII iron group metal and from about 5 to about 30 wt. % of at least one Group VI b metal, on an oxide basis.

18. The process of claim 17 wherein the hydrotreating catalyst is in the sulfide form.

19. The process of claim 12 wherein the hydrocracking catalyst of step (b) comprises from about 1 to about 15 wt. % nickel and from about 10 to about 25 wt. % of a member selected from the class consisting of tungsten, molybdenum and mixtures thereof, on an oxide basis, on a silica-alumina, support.

20. The process of claim 19 wherein the silica-alumina component of the support material contains from about 40 to about 92 wt. % silica.

21. The process of claim 20 wherein the silica-alumina component of the support material contains from about 87 wt. % silica.

22. The process of claim 19 wherein the hydrocracking catalyst support material comprises from about 40 wt. % to about 60 wt. % silica and about 60 wt. % to about 40 wt. % alumina.

23. The process of claim 22 wherein the hydrocracking catalyst support material comprises substantially equal weight portions of silica and alumina.

24. The process of claim 19 wherein the Group VIII iron group metal and Group VI b metals included in the hydrocracking catalyst are in the sulfide form.

25. The process of claim 12 wherein the hydrogenation catalyst of step (c) comprises from about 1 to about 10 wt. % of a member selected from the class consisting of cobalt, nickel and mixtures thereof, and from about 5 to about 30 wt. % molybdenum, on an oxide basis.

26. The process of claim 25 wherein the Group VIII iron group metals and Group VI b metals included in the hydrogenation catalyst are in the sulfide form.

27. The process of claim 12 wherein the effluent oil from hydrogenation step (c) is fractionated to separate an oil of lubricating oil viscosity and the lubricating oil fraction is dewaxed.

28. The process of claim 27 wherein the dewaxed lubricating oil fraction has a viscosity index greater than 110.

29. A process for preparing a mineral hydrocarbon lubricating oil from a mineral hydrocarbon oil feedstock of lubricating oil viscosity, comprising the steps of:

(a) contacting the feedstock with molecular hydrogen under hydrotreating conditions, to avoid undue cracking of said feedstock, in the presence of a supported hydrotreating catalyst comprising from about 1 to about 10 wt. % of nickel and from about 5 to about 30 wt. % molybdenum, on an oxide basis, said hydrotreating conditions comprising a temperature within the range from about 500° F. to about 800° F., a hydrogen partial pressure within the range from about 1,500 to about 3,000 p.s.i.g., a weight hourly space velocity within the range from about 0.5 to 3.0, and a hydrogen rate within the range from about 1,500 to about 2,500 s.c.f./b., provided that less than about 5% by volume of said feedstock is cracked during said contacting to produce materials boiling below about 600° F.;

(b) contacting the effluent oil from step (a) with molecular hydrogen under hydrocracking conditions, in the presence of a hydrocracking catalyst comprising from about 1 to about 15 wt. % nickel and from about 10 to about 25 wt. % molybdenum, on an oxide basis, on a support comprising silica-alumina and alumina containing said hydrocracking conditions comprising a temperature within the range from about 750° F. to about 850° F., a hydrogen partial pressure within the range from about 1,500 to about 3,000 p.s.i.g., a weight hourly space velocity within the range from about 0.5 to about 2.0, and a hydrogen rate within the range from about 1,500 to about 3,000 s.c.f./b.;

(c) contacting the effluent oil from step (b) with molecular hydrogen under hydrogenation conditions such that less than about 5% by volume of said effluent oil from step (b) which boils above 600° F. is cracked to produce material boiling below about 600° F., in the presence of a supported hydrogenation catalyst comprising from about 1 to about 10 wt. % nickel and from about 5 to about 30 wt. % molybdenum, on an oxide basis, said hydrogenation conditions comprising a temperature within the range from about 450° F. to about 650° F., a hydrogen partial pressure within the range from about 2,000 to about 3,000 p.s.i.g., a weight hourly space velocity within the range from about 0.25 to about 2.0, and a hydrogen rate within the range from about 1,500 to about 5,000 s.c.f./b.;

(d) stripping the effluent oil from step (c) with steam to remove light hydrocarbon material boiling below about 600° F., and dewaxing the stripped oil; and (e) recovering a specification grade lubricating oil base stock.

* * * * *